US011785375B2

(12) United States Patent
Madaffari et al.

(10) Patent No.: US 11,785,375 B2
(45) Date of Patent: Oct. 10, 2023

(54) PRECISELY CONTROLLED MICROPHONE ACOUSTIC ATTENUATOR WITH PROTECTIVE MICROPHONE ENCLOSURE

(71) Applicant: Quiet, Inc., La Jolla, CA (US)

(72) Inventors: Peter L. Madaffari, Camden, ME (US); Scott A. Moser, La Jolla, CA (US); Vijay Parsa, London (CA); Niamh C. Finnegan, Bristol (GB)

( * ) Notice: Subject to any disclaimer, the term of this patent is extended or adjusted under 35 U.S.C. 154(b) by 0 days.

(21) Appl. No.: 17/700,069

(22) Filed: Mar. 21, 2022

(65) Prior Publication Data

US 2022/0400334 A1 Dec. 15, 2022

Related U.S. Application Data

(60) Provisional application No. 63/210,631, filed on Jun. 15, 2021.

(51) Int. Cl.

| | |
|---|---|
| ***H04R 1/34*** | (2006.01) |
| ***H04R 1/28*** | (2006.01) |
| ***H04R 1/20*** | (2006.01) |
| ***G10K 11/16*** | (2006.01) |
| ***H04R 1/08*** | (2006.01) |

(52) U.S. Cl.
CPC ..... *H04R 1/342* (2013.01); *G10K 11/16* (2013.01); *H04R 1/083* (2013.01)

(58) Field of Classification Search
CPC . H04R 1/342; H04R 1/34; H04R 1/30; H04R 1/28; H04R 1/222; H04R 1/22; H04R 1/20; H04R 1/083; H04R 1/1083; G10K 11/16; G10K 11/02; G10K 11/04
See application file for complete search history.

(56) References Cited

U.S. PATENT DOCUMENTS

| | | | | |
|---|---|---|---|---|
| 1,700,553 | A | 1/1929 | Swan | |
| 1,909,375 | A | 5/1933 | Muller | |
| 2,408,474 | A | 10/1946 | Newman et al. | |
| 2,485,278 | A | 10/1949 | Gilman et al. | |
| 2,508,581 | A | 5/1950 | Morrow | |
| 2,572,547 | A | 10/1951 | Webb | |
| 2,745,911 | A | 5/1956 | Webb. | |
| 2,769,040 | A | 10/1956 | Di Mattia | |
| 2,855,067 | A | 10/1958 | Di Mattia | |
| 2,857,013 | A | 10/1958 | Orso | |
| 3,201,516 | A * | 8/1965 | Weingartner | H04R 1/38 381/120 |
| 3,946,422 | A | 3/1976 | Yagi et al. | |
| 4,189,627 | A | 2/1980 | Flanagan | |
| 4,263,484 | A | 4/1981 | Hisatsune et al. | |
| 4,281,222 | A | 7/1981 | Nakagawa | |
| 4,401,859 | A * | 8/1983 | Watson | H04R 1/342 381/357 |

(Continued)

FOREIGN PATENT DOCUMENTS

| | | | | |
|---|---|---|---|---|
| EP | 0453061 | A2 * | 10/1991 | H04M 1/20 |
| GB | 2228646 | A | 8/1990 | |

(Continued)

*Primary Examiner* — Edgardo San Martin

(74) *Attorney, Agent, or Firm* — Buche & Associates, P.C.; John K. Buche; Bryce A. Johnson

(57) ABSTRACT

The acoustic attenuator also serves as a protective microphone enclosure that reduces exposure to debris as well as environmental humidity 5 and harmful gases.

18 Claims, 12 Drawing Sheets

(56) References Cited

U.S. PATENT DOCUMENTS 4,410,770 A * 10/1983 Hagey ..... H04R 1/222 381/357
4,584,702 A 4/1986 Walker, Jr.
4,773,091 A 9/1988 Busche et al.
4,807,612 A 2/1989 Carlson
4,815,560 A * 3/1989 Madaffari ..... H04R 1/222 381/328
4,837,833 A * 6/1989 Madaffari ..... H04R 25/48 381/174
4,852,683 A 8/1989 Killion
5,473,684 A 12/1995 Bartlett et al.
5,539,834 A 7/1996 Bartlet et al.
5,878,147 A * 3/1999 Killion ..... H04R 1/406 381/328
6,122,389 A 9/2000 Grosz
6,690,800 B2 2/2004 Resnick
6,707,920 B2 * 3/2004 Miller ..... H04R 1/2807 381/326
6,757,399 B1 6/2004 Cheng
7,050,597 B2 5/2006 Akino
7,072,482 B2 7/2006 Van Doorn
7,136,500 B2 11/2006 Collins
7,245,726 B2 7/2007 Du et al.
7,298,859 B1 11/2007 Worley et al.
7,623,671 B2 11/2009 Akino
7,783,034 B2 8/2010 Manne
8,416,978 B2 * 4/2013 Fukuda ..... H04R 1/2853 381/353
8,428,285 B2 4/2013 Khamashta et al.
8,848,963 B2 * 9/2014 Menyhart ..... H04R 1/38 381/355
9,118,989 B2 8/2015 Zukowski
9,463,118 B2 * 10/2016 Meegan ..... H04R 1/1083
9,571,919 B2 2/2017 Hsu Huang et al.
9,596,533 B2 3/2017 Akino
9,609,411 B2 3/2017 Parkins
9,628,897 B2 4/2017 Fletcher et al.
9,654,873 B2 5/2017 Akino
9,838,801 B2 * 12/2017 Akino ..... H04R 19/04
9,888,307 B2 * 2/2018 Vitt ..... H04R 1/086
9,912,819 B2 3/2018 Webb et al.
9,924,261 B2 3/2018 Parkins
9,936,284 B2 4/2018 Howes et al.
10,257,610 B2 * 4/2019 Harney ..... H04R 1/04
10,419,841 B2 * 9/2019 Sibbald ..... H04R 19/04
10,771,904 B2 * 9/2020 Schultz ..... H04R 3/04
10,820,083 B2 * 10/2020 Szczech ..... H04R 1/086
11,146,884 B2 10/2021 Chang et al.
2005/0089180 A1 4/2005 Saeki et al.
2005/0135648 A1 6/2005 Lee
2010/0067732 A1 3/2010 Hachinohe et al.
2011/0280418 A1 11/2011 Matsunga
2012/0139066 A1 6/2012 Je et al.
2013/0035744 A1 * 2/2013 Wiskerke ..... H04R 1/08 607/57

FOREIGN PATENT DOCUMENTS

JP 4533784 B2 9/2010
WO 1989004106 A1 5/1989
WO WO-2021178390 A1 * 9/2021 ..... A01C 7/105

* cited by examiner

SECTION A-A
SCALE 10

PRECISELY CONTROLLED MICROPHONE ACOUSTIC ATTENUATOR WITH PROTECTIVE MICROPHONE ENCLOSURE

CROSS-REFERENCE TO RELATED APPLICATIONS

This application is a non-provisional filing of U.S. App. Ser. No. 63/210,631, entitled Precisely Controlled MICROPHONE Acoustic Attenuation with Protective Microphone Enclosure (filed Jun. 15, 2021), which is incorporated herein by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of acoustic attenuators for microphones to prevent sound distortion from high sound pressure levels.

Background of the Invention

With the varied uses and requirements for microphones and sound recording, there is an increased need for devices that can be manufactured at a low cost that can precisely control acoustic attenuation in varied environments. A microphone is a listening device capable of converting sounds, such as the human voice, into electrical signal. In certain environments which place the microphone close to the sound's source, such a speaker's mouth inside a helmet or mask, the proximity to the microphone results in a high sound pressure level environment and distorts the electrical signal. Normal speech occurs in the range of 50 to 70 dB sound pressure level (SPL) when measured 36" away from the speaker's mouth. While it is not unusual for sounds to exceed this range, such as the music at a concert or with construction equipment like jackhammers, normal speech 36" away from the microphone rarely does. In line with typical speech, most mass-produced microphones made at a low cost that are designed for voice recording have minimal distortion up to 110 dB SPL and cost around $1 each to produce. For a microphone to function at higher sound pressure levels, it must be designed with more complicated physical and electrical structure and, as a result, is more expensive to produce or have an external acoustic attenuator attached to the microphone.

Generally, these inexpensive microphones are composed of an acoustic section, a transducer section, and an amplifier section. The acoustic section leads sound into the microphone housing and to the transducer and is primarily made up of stamped metal or formed plastic components. The transducer section converts the sound to an electrical signal and is typically constructed with batch processed of materials and sometimes employs semiconductor techniques. Finally, the amplifier section takes the electrical signal and amplifies it and is also often formed using semiconductor processes. Amplifiers use basic circuitry with a single field effect transistor that is configured in a common drain or common source configuration. These amplifiers are usually powered with as few as 0.9 volts, and rarely exceed three volts.

When these microphones are exposed to loud sounds, the amplifier is generally the component that prevents a clear recording. The amplifier's restricted power supply and diode junctions restrict the acoustic input to about 110 dB SPL. On the other hand, the acoustic and transducer components can handle acoustic levels of at least 140 dB SPL and up to 160 dB SPL at high fidelity.

Microphones can be designed to overcome amplifier limitations, but the increased physical and electrical complexity drastically raise the price to manufacture to a point where it is not a reasonable solution. Therefore, an ideal solution is an inexpensive acoustic attenuator that can be used with an inexpensive microphone to allow use in high SPL environments without appreciable distortion.

High SPL environments frequently exceed microphones' 110 dB SPL limit either by loud sounds or sound being near the microphone. When calculating sound levels, every time distance between the mouth and the microphone halves, the sound pressure level doubles. Sound follows a $1/r^2$ law, where decreasing the distance from 36" to 1" results in an increase of about 30 dB in a free-field environment. SPL increases of this amount moves a normal speaking voice up to 100 dB SPL, which frequently crosses most microphones' 110 dB SPL distortion threshold.

Additionally, when in a small, closed environment, such as having the microphone enclosed and placed against the mouth, the sound pressure level will be even higher and changes the necessary calculations for the sound pressure level. Specifically, an environment is small when the largest dimension of the enclosure is less than 25% of the frequency's ($f_o$) wavelength ($\lambda$). The wavelength can be found by dividing the speed of sound (c), which is 344,000 mm/sec, by the frequency, or $\lambda=c/f_o$. For example, a normal speaking volume in a closed space could result in a sound pressure level as much as 4.5 orders of magnitude higher than in an open space. When under the calculated frequency, the volume can be represented by a lumped parameter model approach where the pressure is equalized in the enclosure but periodically varies, similar to the performance of an acoustic attenuator. Below the frequency, there is no standing wave, which could be interpreted as the attenuator's walls being anechoic. As the frequency increases, the lumped parameter model transitions to a waveguide interpretation for sound pressure within the attenuator.

Both the human voice and a speaker are best modeled as a current source in series with a network, and the element representing the load where sound pressure is measured depends on whether the sound is broadcast to an open space or constrained. When in closed space, the sound pressure level will be orders of magnitude higher than in open space because the energy is confined to a very small volume of air. For example, in open space, sound recorded 36" away from the source with a frequency of 100 Hz would have 50-70 dB SPL. When the same force is applied in a closed volume of about 2.4 cubic inches, there is a 90 dB SPL increase, which ranges from 140-160 dB SPL.

160 dB SPL is approximately the same sound level as being near an active jet engine, which is both dangerous to the human ear and difficult for a microphone to record without distortion. To protect people or use a microphone without the high sound pressure level overloading it, some common solutions are using active ear protectors or passive ear protectors. Active ear protectors use electronic level converters to convert the signal from an external microphone to an internal speaker placed within the ear canal while reducing the sound to acceptable levels. These active protectors are both expensive and require a large amount of extra technology beyond a single common microphone. On the other hand, passive ear protectors essentially function like acoustic attenuators, using a diaphragm and a volume to tailor the frequency response shape like the open ear does. However, passive ear protectors are generally large, bulky, expensive, and difficult to keep clean due to their direct contact with the external environment and the open ear.

Accordingly, a need exists for an acoustic attenuator with a flat frequency response that has a method to change the attenuation level, has a broad attenuation, is adjustable, and can be manufactured at low cost.

A microphone converts sound energy to electric energy in a linear, one-to-one translation up to a maximum input signal level. When the maximum input signal level is exceeded, the electrical output is distorted. The distortion can either be harmonic distortion or intermodulation distortion, and both can reduce speech intelligibility or speech or music quality.

Harmonic distortion occurs when a pure tone is deformed when it is transformed from an acoustic to electric signal, or from electric to acoustic signal. The pure tone's harmonics are introduced to the output and accompany the pure tone.

Intermodulation distortion occurs when at least two tones are present and the level of one tone, often the lower frequency, is much higher than the other. The first higher frequency tone's level is low enough that that no harmonic distortion would occur, although the presence of the second lower signal periodically affects the first signal's tone according to the frequency. As a result, the first signal's harmonics vary in level with time, and could become distorted even if the second signal is not within audible range.

Both types of distortion can be prevented by either making the microphone's operational sound pressure range as large as possible or by reducing the incoming signal's sound pressure range without changing the frequency response shape before it reaches the microphone.

A microphone's operational sound pressure range is limited both by the transducer's mechanical displacement boundaries such that it transitions from a linear to a non-linear operation as it approaches those boundaries and the microphone's pre-amplifier, usually located within the microphone housing. The transducer usually provides an exceptionally low power electrical signal. The pre-amplifier must boost that signal's power by increasing the output electrical current, increasing the electrical voltage, or increasing both.

Because of size constraints, the microphone is often powered by a battery or single cell. When the microphone encounters a high sound pressure level, the electrical signal swing may exceed the power supply's limits. To minimize the risk of exceeding the power supply, good amplifier design centers the dormant operating point midway between the power supply voltage and ground. Additionally, when in high SPL environments, good microphone design also attenuates the transducer's internal electrical signal before reaching the pre-amplifier stage but may compromise the microphone's signal to noise ratio. However, compromising the signal to noise ratio may be permissible by either having the design with a high initial signal to noise ratio to overcome internal attenuation or when the desired acoustic input signal is in the microphone's elevated range.

When discussing signal to noise ratio, noise is an unwanted signal. Microphone noise can either be internal or external. Internal noise is the electrical output of the microphone without any acoustical input, or noise created from within the microphone itself. Internal noise is usually measured in an anechoic chamber and is defined in terms of the equivalent SPL as an acoustical signal that would produce that microphone's output noise signal. Internal noise is usually given in decibels relative to the lowest sound pressure level a young human could hear. Internal noise is usually an exceptionally low level, where one Pascal is a microphone's common signal level and is 94 dB above this internal noise referent level, which is a factor of over 50,000 to 1.

The external noise is what the microphone picks up when exposed to unwanted sounds. For example, a singer's microphone singer picks up her voice as the wanted signal, and any picked up from the audience would be the external noise. The signal to noise ratio for the singer is the ratio as measured in decibels between her voice and the sounds of the crowd, measured separately.

External noise is often not controllable from the microphone's position, like the singer not being able to control crowd noise. However, singer's sound energy measured by the microphone, her voice, varies as the inverse square of the distance from her mouth to the microphone's sound inlet. Accordingly, the sound energy of her voice at 1" from her mouth, compared to the level 36" away, is 31 dB higher than it would be at a distance. Therefore, to maximize her voice over the crowd's noise, she should place the microphone as close to her mouth as possible. This open exposure scenario will be Example A.

A second possibility is the speaking person is talking into a small, enclosed space, such as a protective mask. Here, there is no inverse square signal drop off, but the signal level in the enclosure is inversely proportional to the enclosed volume. This usually produces a sound pressure level higher than in the previous open example with a singer and crowd.

In both examples the sound pressure level could be high enough to overload the microphone depending on the proximity to the mouth and the enclosure's size, respectively. These variables may not be controlled, and the sound pressure level may vary over some broad range.

Prior art exists that have attempted to solve these issues but have failed to adequately provide a precisely controlled microphone acoustic attenuator. U.S. Pat. No. 4,584,702 by Walker discloses a noise cancelling device that attenuates noise but does not alter the normal sound amplitude. U.S. Pat. No. 4,773,091 by Busche discloses a noise-cancelling microphone, although the signal attenuation is achieved with an electrical resister instead of a diaphragm. U.S. Pat. No. 5,473,684 by Bartlett discloses a second order directional microphone that uses the sound field's spatial variation to reduce sound pickup from unwanted directions. U.S. Pat. No. 5,539,834 by Bartlett also discloses a second order directional microphone. U.S. Pat. No. 7,783,034 by Manne discloses a non-rigid privacy mask using a microphone mounted in a tube, although fails to discuss the tube's acoustical purpose or signal attenuation. U.S. Pat. No. 9,118,989 by Zukowski discloses a directional microphone.

U.S. Pat. No. 9,596,533 by Akino discloses a close-talking directional microphone. U.S. App. 2005/0135648 by Lee discloses an acoustic filter created by multiple plates with etchings. The filter attaches to a microphone and changes the microphone's frequency response. U.S. App. 2010/0067732 by Hachinohe discloses a similar acoustic filter created by multiple etched plates. WO1989/00410 by Lynn discloses an acoustic filter microphone cup which is designed to alter the microphone's frequency response. The prior art generally focuses on altering microphone's frequency response instead of attenuating all sound coming into the microphone.

Accordingly, a need exists for an attenuator that could be inexpensively produced and attached to an existing microphone. A further need exists for acoustic attenuators that could be purchased for multiple different microphones in steps up to some maximum level. A further need exists for an attenuator that could be continuously adjustable from some minimum level up to a maximum level while also remaining fixed if necessary.

SUMMARY OF THE INVENTION

In view of the foregoing, an object of this specification is to disclose an acoustic attenuator for a microphone.

It is a further object of this disclosure to specify an acoustic attenuator for a microphone that is an enclosure for the microphone.

It is a further object of this disclosure to specify an acoustic attenuator that is precisely controlled to account for various different sound pressure levels.

It is a further object of this disclosure to specify an acoustic attenuator that is resistant to, and shields the microphone from, debris, moisture, and harmful gases.

Other objectives of the disclosure will become apparent to those skilled in the art once the invention has been shown and described.

In view of the foregoing, what is disclosed may be A passive acoustical attenuator for a microphone, said acoustical attenuator combining attenuation to lower a sound level of a sound introduced into the microphone with physical protection for the microphone, said acoustical attenuator defined by a an enclosed volume of space bounded by a sound inlet at the proximate end, containing a diaphragm structure and bounded at the distal end by a sound outlet sealed to a microphone, wherein the sound entering at the proximate inlet is reduced in level according to the divider effect of acoustical compliances of the diaphragm and the enclosed volume of space that is approximately constant over a wide acoustical range of speech. An alternative attenuator may have a situation where the microphone to which the attenuator is attached is miniature to sub-miniature in size. In yet another embodiment, an attenuator as could feature a diaphragm structure that is removable and replaceable. A different attenuator could be reduced in net size for the same attenuation by the use of two attenuator sections.

What is disclosed may also be a precisely controlled microphone acoustic attenuator comprising:

an attenuator collar;
an attenuator shell;
a microphone adapter ring;
a diaphragm assembly; and,
a circular collar.

In this preferred embodiment, the diaphragm assembly may comprise:

A diaphragm stepped shoulder;
A diaphragm flange; and,
A diaphragm film.

In use, the disclosed technology may define a method for precisely controlling microphone acoustic attenuator comprising:

obtaining a microphone acoustic attenuator;
said attenuator comprising:
an attenuator collar;
an attenuator shell; and,
a diaphragm assembly;
calculating the precise amount of desired attenuation;
attaching the acoustic attenuator to a microphone; and,
sealing the acoustic attenuator to the microphone.

In the preferred method, the attenuator collar could further comprise an attenuator sound inlet within the attenuator collar.

BRIEF DESCRIPTION OF THE SEVERAL VIEWS OF THE DRAWINGS

The manner in which these objectives and other desirable characteristics can be obtained is explained in the following description and attached figures in which.

Figure 1A:
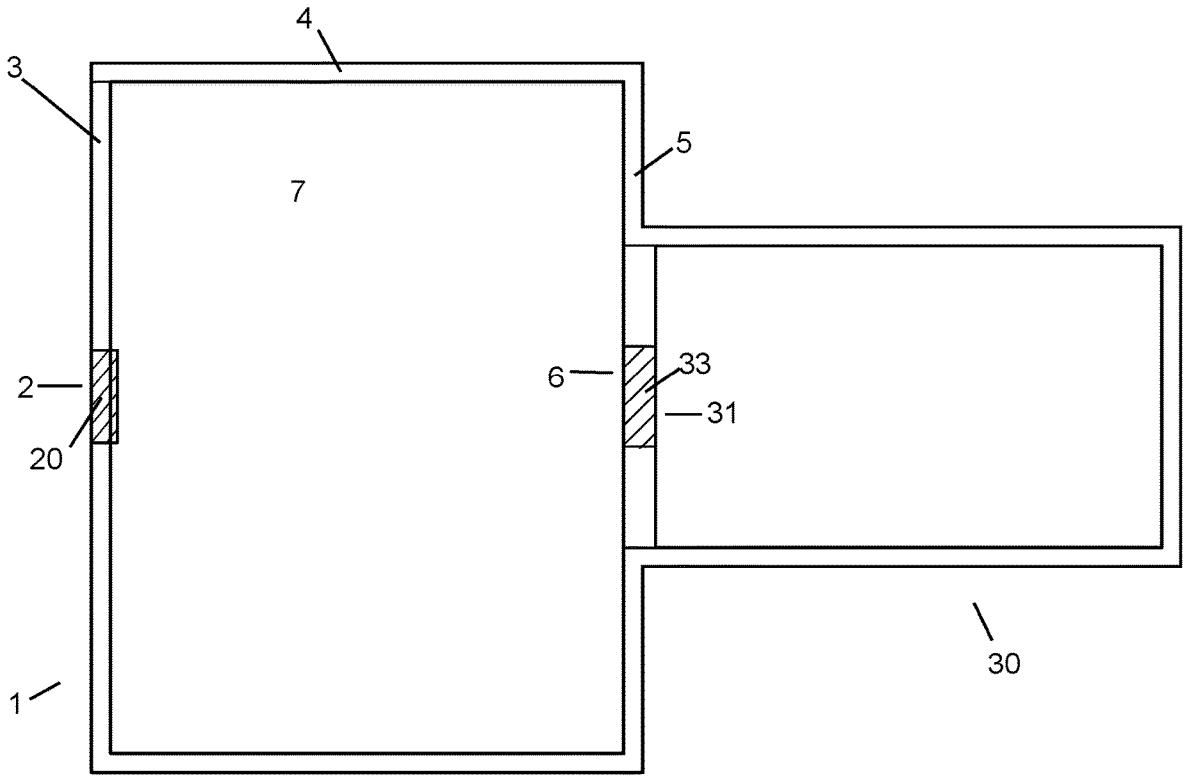
FIG. 1A is cross-sectional view of an embodiment of an acoustic attenuator.

In the drawings, the following reference numerals correspond with the associated components of the acoustic attenuator:

1—acoustic attenuator;
2—attenuator sound inlet;
3—attenuator collar;
4—attenuator shell;
5—microphone adapter ring;
6—attenuator sound exit;
7—enclosed volume;
20—attenuator diaphragm assembly;
21—diaphragm pocket;
22—stepped shoulder;
23—slot;
24—flange;
25—diaphragm film;
30—microphone;
31—microphone sound inlet;
32—microphone wiring;
33—microphone diaphragm;
34—microphone coil;
35—microphone magnet;
40—circular collar.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally disclosed is a precisely controlled microphone acoustic attenuator with protective microphone enclosure. In use, the attenuator may be disposed in a telephone handset and be used for voice to text dictation. In the preferred use, the attenuator with protective microphone enclosure may be used to assist users with impaired speech to communicate more effectively. The details of a preferred embodiment of an attenuator are described in connection with the figures.

FIG. 1A is a cross-sectional view of one embodiment of the acoustic attenuator 1. The embodiment features an acoustic attenuator 1 connected to a microphone 30 to passively decrease the sound pressure level of incoming sounds to minimize distortion on the output. The acoustic attenuator 1 is defined by an attenuator sound inlet 2, attenuator collar 3, attenuator shell 4, microphone adapter ring 5, attenuator sound exit 6, acoustic volume 7, attenuator diaphragm assembly 20, and microphone 30. The preferred embodiment of the acoustic attenuator 1 and its components is composed of metal, although alternative embodiments can be made of plastic or other material that is low in cost to manufacture, easy to stamp and mold, and sufficiently insulated against both sound waves and environmental hazards that could potentially damage a microphone. The microphone 30 is defined by a microphone sound inlet 31, microphone wiring 32, microphone diaphragm 33, microphone coil 34, and microphone magnet 35. When the attenuator 1 is attached to the microphone 30, sound, such as a human voice, first enters through the attenuator sound inlet 2, or diaphragm slot 3, and the attenuator diaphragm assembly 20. The diaphragm 20 passively reduces the sound pressure level as the sound passes through the diaphragm 20 into the interior of the attenuator 1, or the acoustic volume 7. The diaphragm assembly 20 is set in diaphragm slot 23 of the attenuator collar 3; the attenuator collar 3 is the outward-facing component of the acoustic attenuator and makes up the front plate of the attenuator shell 4. The sound moves through the acoustic volume 7 to the attenuator sound exit 6, which is opposite the attenuator sound inlet 2, and through the microphone diaphragm 33 and microphone sound inlet 31 to have the microphone translate the sound from mechanical to electronic signal.

Figure 1B:
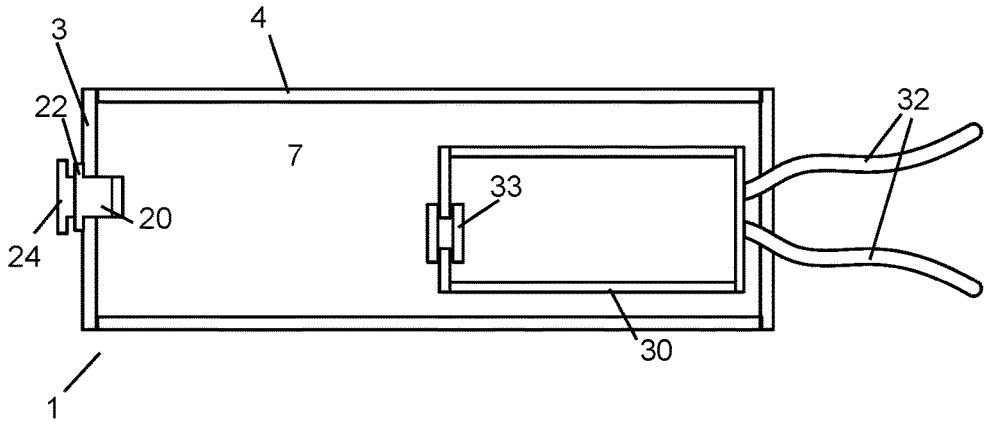
FIG. 1B is a cross-sectional view of an acoustic attenuator with a microphone fully enclosed.

FIG. 1B is a cross-sectional view of another embodiment of the acoustic attenuator 1 where the microphone 30 is placed within the acoustic volume 7; FIG. 1B has similar components and functions to FIG. 1A, with the difference being the placement of the microphone.

Figure 7A:
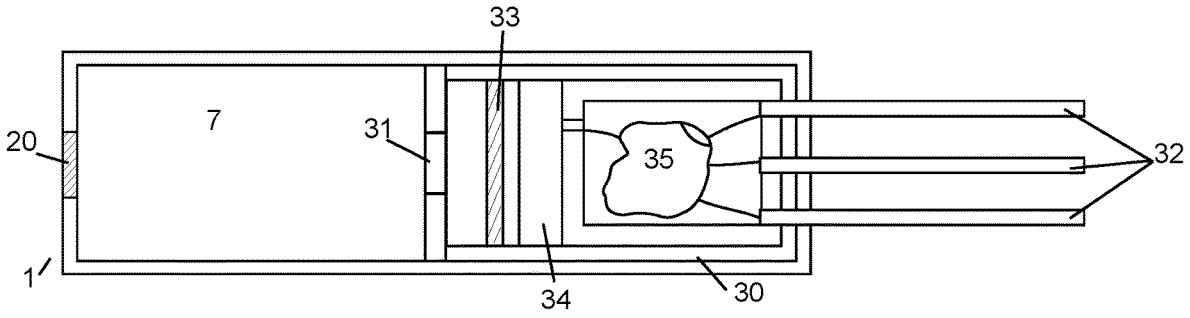
FIG. 7A is a frontal cross-sectional view of the alternate embodiment of the acoustic attenuator of FIG. 6.
Figure 7B:
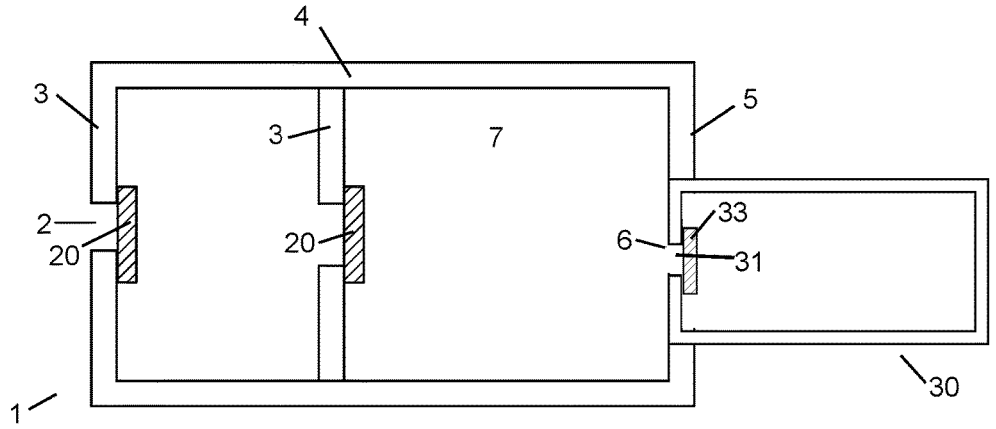
FIG. 7B is a cross-sectional view of the side of the alternate embodiment of the acoustic attenuator of FIG. 7A.

FIGS. 7B and 7A are detailed versions of FIGS. 1A and 1B, respectively. The figures illustrate two preferable embodiments that form the attenuator, although there are several other additional alternate embodiments. In FIG. 7A, the diameter of the final attenuator with a microphone is approximately the same as the microphone's diameter. If the relative compliance (capacitance) is such that Cpro is approximately equal to Ct, then the transducer diaphragm and Cpro could be identical. The relative size of Cvol to Ct is the ratio of the length of the chamber to the length of the microphone. For example, if Cvol≈Ct≈Crv, then the chamber length would be about the length of the microphone. In that case the attenuation would be about 8 dB. An alternate structure is shown by 1A. Note that the microphone is not shown in FIG. 1A but would be the same microphone structure as shown on FIG. 7A. The attenuator structure in FIG. 1A would have Cpro=10*Ct and Cvol=16*Ct. The compliance of a diaphragm is proportional to the square of the radius (and inversely proportional to the cube root of the thickness) so to achieve Cpro=10*Ct, Cpro would have a diameter about 3.16 times the diameter of the membrane used to make Ct. To achieve Cvol=16*Ct, the diameter of the circular chamber would need to be 4 times that of the microphone. Note that the in both examples the attenuation could be varied by adjusting the length of chamber forming Cvol. In FIG. 7A this could be achieved by sliding the microphone further in or further out of the sleeving. In FIG. 1A, the walls forming Cvol could be telescoped back and forth to achieve the same effect. Additionally, microphone manufacturers can make it easier to achieve Cpro Ct because they could make additional microphone diaphragms and repurpose them as Cpro. Also, greater attenuation is more easily achieved by increasing the diameter of the chamber forming Cvol, and because of this FIG. 1*a* could be preferable to FIG. 7A.

Still referring to FIG. 7A, adjusting the attenuation also adjusts the sensitivity of the microphone. The adjustments can achieve better uniformity from microphone to microphone because the sensitivity of the base microphones normally varies by +/−3 dB to +/−4 dB according to industry specifications. Using smaller or larger pressure relief vents and appropriate acoustic inductances and resistances for high resonances and roll offs can also provide additional frequency shaping for the microphone's response.

FIG. 7B is an alternate embodiment of an attenuator. If space is a premium, FIG. 7B teaches how to appreciably increase the attenuation without appreciably increasing the volume. FIG. 7B depicts two Acoustic Attenuators in series, where each section as the capacitance for its diaphragm and for its volume. This concatenated approach essentially doubles the volume of the attenuator, but doubles the attenuation as expressed in decibels (dB). For example, taking a 30 dB attenuator and then doubling its volume only increases its attenuation to 36 dB. To get 60 dB attenuation would require a volume about 33 times the original. However, using two attenuators in series raises the attenuation to 60 dB while only doubling the volume.

Figure 2A:
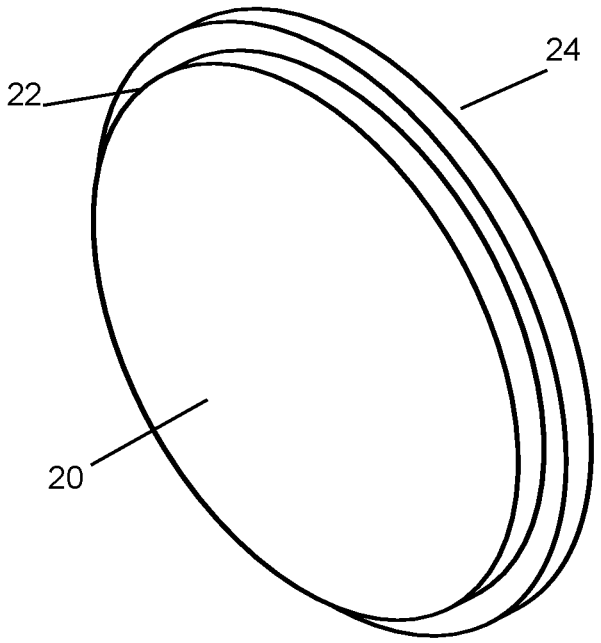
FIG. 2A is a perspective view of a diaphragm of the acoustic attenuator of FIG. 1.

FIG. 2A is a perspective view of one embodiment of the attenuator diaphragm assembly 20; the diaphragm assembly is defined by a diaphragm pocket 21, stepped shoulder 22, slot 23, flange 24, and diaphragm film 25. Suitably, the diaphragm enables passage of sound into the acoustic pocket or volume 7. In a preferred embodiment, the diaphragm assembly is composed of metal or plastic, much like the acoustic attenuator, to best be suitably molded and shaped into the necessary dimensions, although could also be composed of other suitable materials that provide similar benefits. The diaphragm film 25 is ideally composed of polyethylene terephthalate, or mylar, which is a polyester, although could also be composed of other suitable materials capable of damping incoming sounds in a similar manner. When placed into the attenuator 1, the diaphragm is inserted into the attenuator collar 3 to cover the attenuator sound inlet 2. The diaphragm assembly 20 contacts the collar 3 with the stepped shoulder 22, which, in a preferred embodiment, is affixed to the collar 3 with a dissolvable cement, although in other embodiments could be attached through removable adhesive or other means that allow the diaphragm assembly to remain closely affixed to the attenuator and prevent debris or other unwanted environmental hazards inside the attenuator or microphone.

Figure 2B:
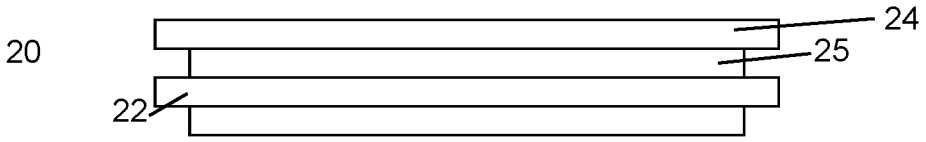
FIG. 2B is a side view of the diaphragm of FIG. 3*a;*

FIG. 2B is a side view of the diaphragm assembly 20. The diaphragm flange 24 faces the external environment and is opposite the acoustic attenuator 1; the stepped shoulder 22 sits between the flange 24 and collar 3. The diaphragm film 25 is attached to the flange 24 and acts as an acoustic diaphragm; the film 25 reduces the sound pressure level of incoming sounds by damping the physical vibrations created by the incoming sound, before the sound enters the acoustic volume 7 and the microphone 30. Should any portion of the diaphragm assembly 20 become compromised, the entire assembly can be removed from the attenuator by stripping the adhesive holding the assembly 20 to the attenuator 1, replacing the damaged par or the assembly as a whole, and then reaffixing the assembly to the attenuator.

Figure 3:
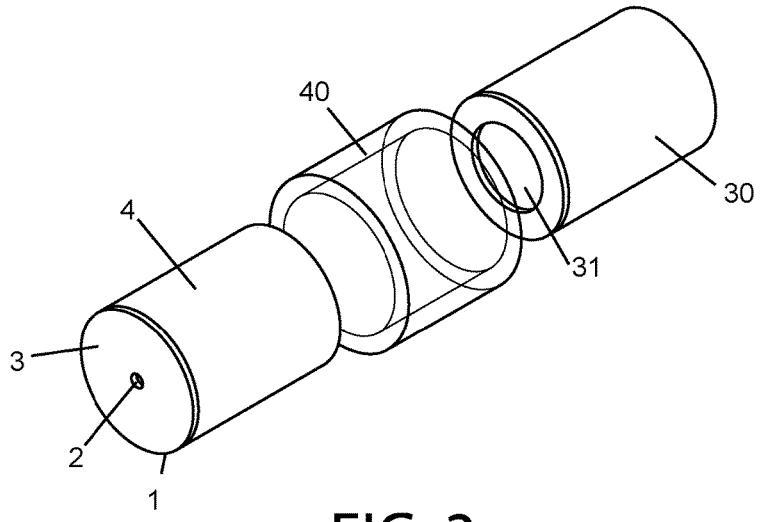
FIG. 3 is an exploded view of an alternate embodiment of an attenuator.

FIG. 3 is a perspective view of an alternate embodiment of an acoustic attenuator 1 with a microphone 30 and a circular collar 40; the circular collar 40 is an alternate method of attaching the attenuator 1 to the microphone 30 and functions as an increased acoustic volume 7, which increases the sound's attenuation before reaching the microphone sound inlet 31. In a preferred embodiment, the collar 40 is made of metal or plastic, the same material as the attenuator 1, to properly function as the acoustic volume 7, prevent sound from escaping, and be easily shaped and molded to the desired specifications, although in alternative embodiments may be made of other materials that meet these requirements. The collar 40 also allows the attenuator's sound pressure levels to be either increased or decreased by moving the microphone closer or further away from the diaphragm assembly 20 to find the ideal attenuation level before the two are sealed in place within the collar 40. When sealing the attenuator and microphone, if using a caustic adhesive such as cement, it is important to allow noxious vapors to escape to prevent damage to the diaphragm film 25; a small hole can be drilled in the wall of the attenuator to allow harmful cement vapors to escape while cement is applied. Once the cement is dried and the attenuator and microphone are affixed to the collar 40, the small hole can be filled with cement to restore use to the attenuator.

Figure 4B:
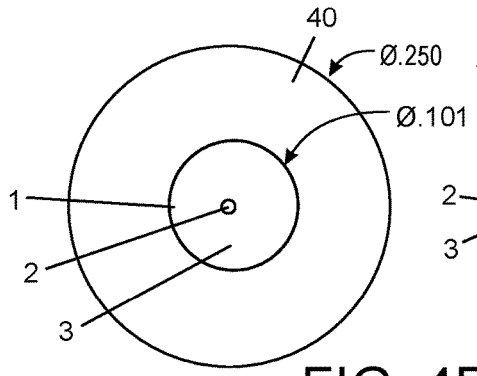
FIG. 4B is a front view of the attenuator of FIG. 4.
Figure 4C:
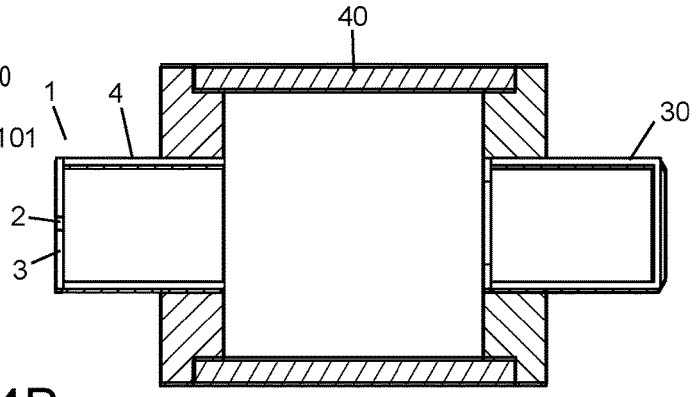
FIG. 4C is a cross section of the attenuator of FIG. 4.
Figure 4A:
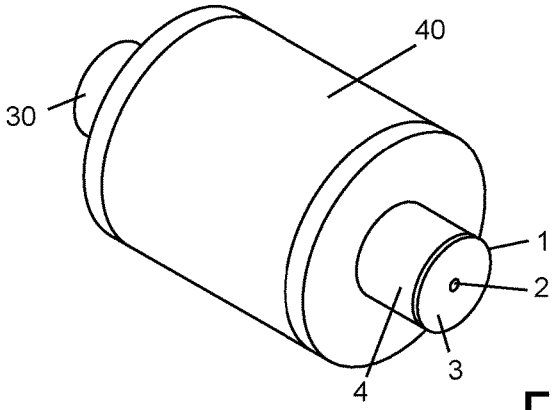
FIG. 4A is a perspective view of an alternate embodiment of an acoustic attenuator with a microphone and a cylindrical collar.

FIGS. 4A and 4B depict alternate views of the acoustic attenuator 1 and microphone 30 with the circular collar 40. Specially, FIG. 4A is a perspective view of one embodiment of the attenuator 1 and microphone 30 fixed within the circular collar 40 and FIG. 4B is a cross-sectional view of the attenuator and microphone fixed within the circular collar 40.

Figure 5A:
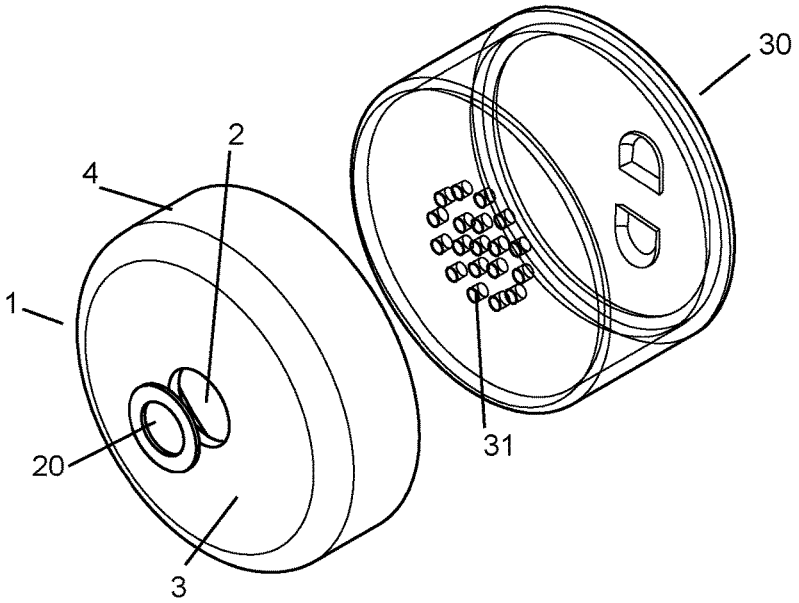
FIG. 5A is a perspective view of an alternate embodiment of an acoustic attenuator with a microphone and a cylindrical collar.

FIG. 5A is a perspective view of an alternate embodiment of the acoustic attenuator 1 showing the attenuator separate from the microphone 30 and the diaphragm assembly 20 removed; the diaphragm assembly 20 is affixed to the attenuator collar 3, to cover the attenuator sound inlet 1 to filter incoming sounds. The attenuator shell 4 is attached to the microphone 30 while leaving space between the attenuator collar 3 and microphone sound inlet 31, to form the acoustic volume 7; the microphone sound inlet 31 is placed inside the acoustic volume 7 so that the microphone inlet 31 is adjacent to the attenuator sound exit 6.

Figure 5B:
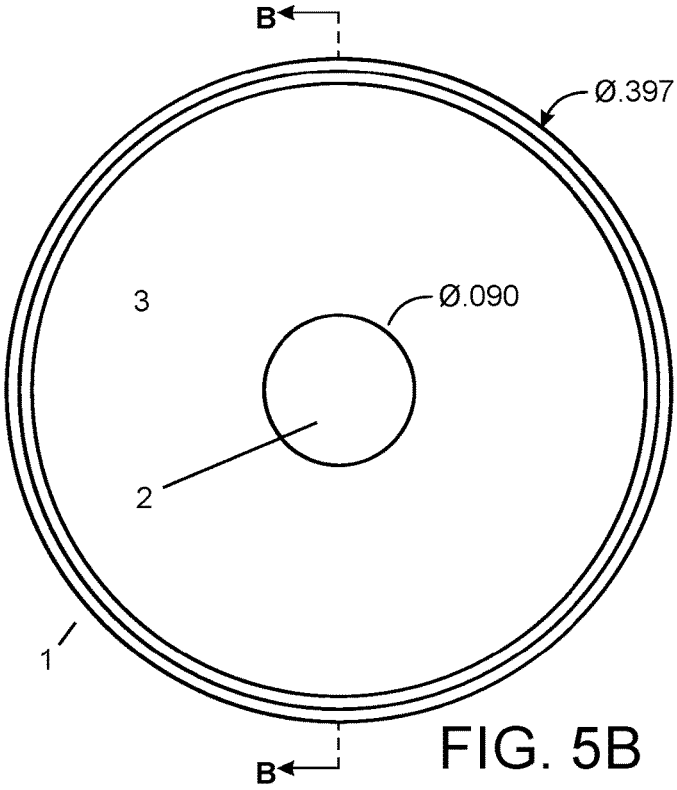
FIG. 5B is a frontal cross-sectional view of the alternative embodiment of an acoustic attenuator with the microphone and the cylindrical collar of FIG. 5A.
Figure 5C:
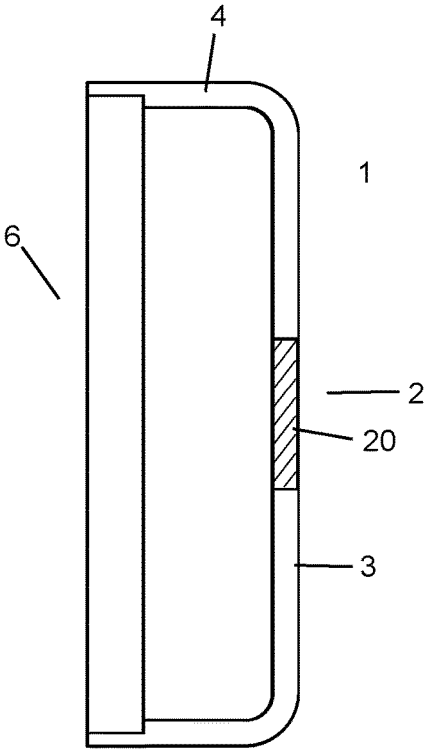
FIG. 5C is a cross-sectional view of the side of the alternative embodiment of an acoustic attenuator with the microphone and the cylindrical collar of FIG. 5A.

FIG. 5C is a cross-sectional view of the acoustic attenuator 1; the attenuator collar 3 has a space in its center to serve as the attenuator sound inlet 2, which is then filled with the diaphragm assembly 20. The space in the center of the collar 3 is preferably circular, although in alternate embodiments may be square, rectangular, triangular, or shaped in other styles that do not negatively affect the sound quality and do not add distortion. The attenuator shell 4 is attached to the edges of the microphone 30 to form the acoustic volume 7 and to protect the microphone from debris or other harmful environmental conditions such as gases or humidity.

Figure 6:
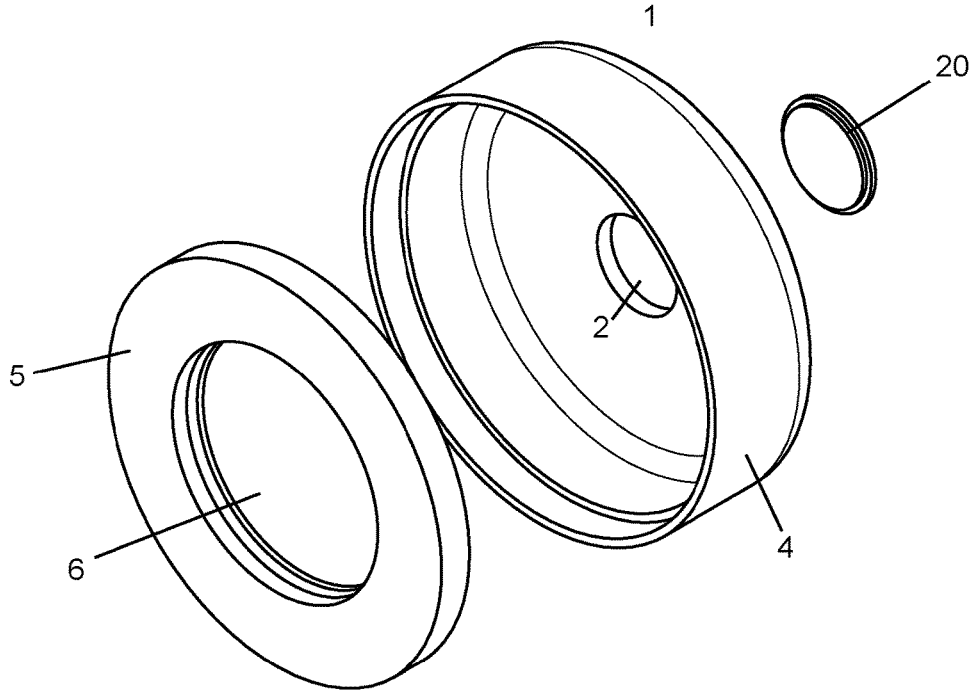
FIG. 6 is a perspective view of an alternate embodiment of an acoustic attenuator.

FIG. 6 is a perspective view of the acoustic attenuator 1 featuring the microphone adapter ring 5; the adapter ring 5 can be different sizes to allow for differently sized microphones with smaller diameters to be used with a single size acoustic attenuator 1. The microphone adapter ring 5 is preferably circular to accommodate most microphones, although in alternate embodiments may be square, rectangular, triangular, or shaped in other styles that do not negative affect sound quality and allow for consistent adhesion with a microphone. The microphone adapter ring 5 is preferably composed of identical material to the attenuator 1 it is used with to create a homogenous attenuator that will respond consistently to wear over time and any harmful external factors or environments.

Figure 8:
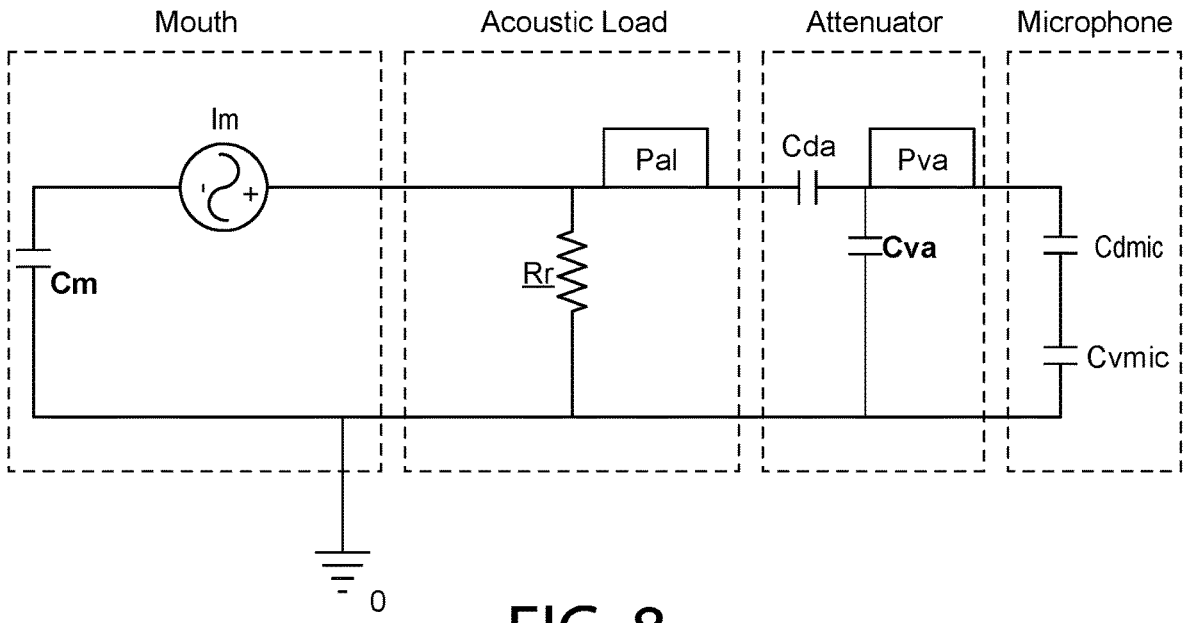
FIG. 8 is an electrical circuit diagram of the acoustic attenuator of FIG. 1 in a free-field application.
Figure 9:
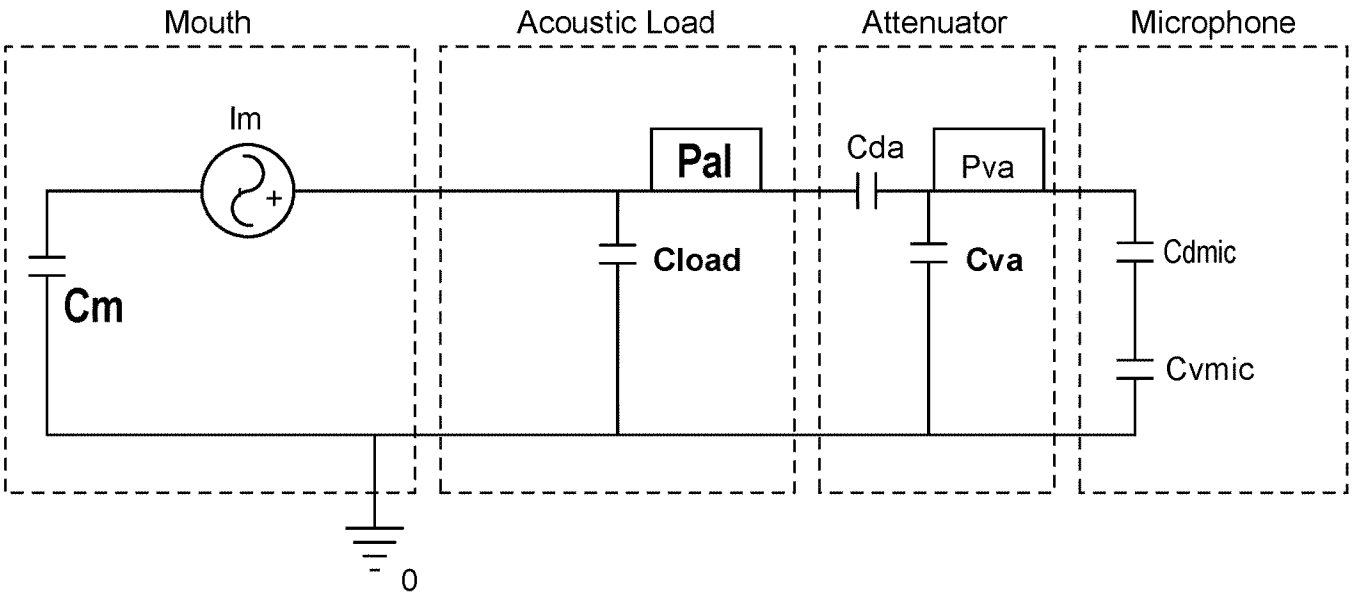
FIG. 9 is an electrical circuit diagram of the acoustic attenuator of FIG. 1 in a small volume application.
Figure 10:
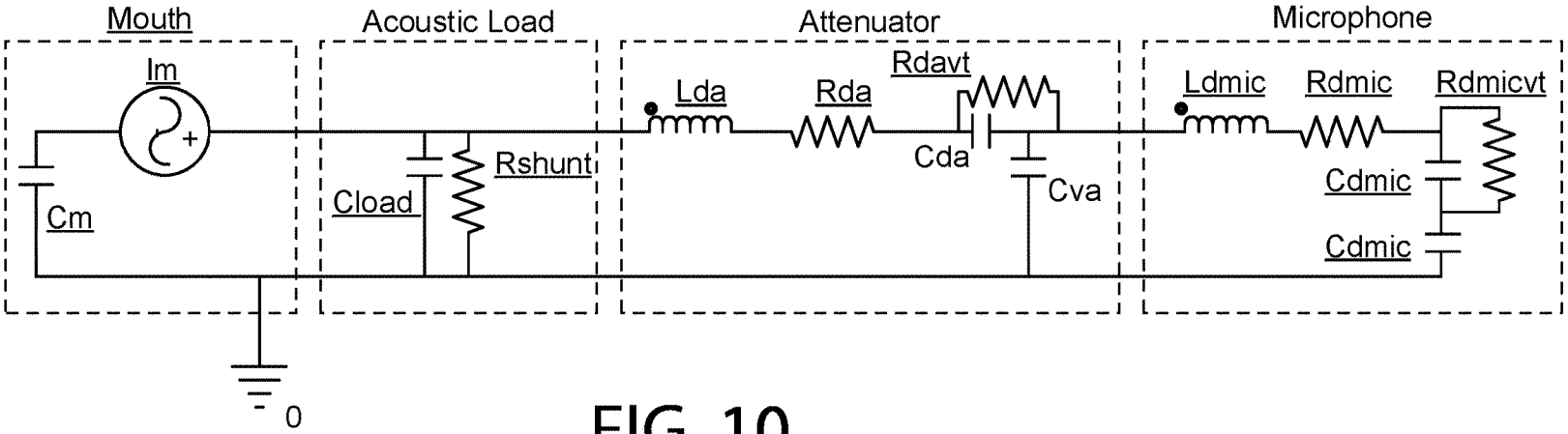
FIG. 10 is an electrical circuit diagram of the acoustic attenuator of FIG. 1 in a small volume application with potential compromises resulting from either low or high frequencies.

FIGS. 8, 9, and 10 depict basic electrical analogs for the acoustic attenuator 1 and microphone 30. FIG. 8 depicts the attenuator's use in a free field, while FIGS. 9 and 10 depict the use in an enclosed cavity with FIG. 10 additionally showing additional elements that may cause or abate performance modifications. The analogs are divided into four sections which represent, in order, the operation of the mouth, the acoustic load, the attenuator, and the microphone 30. For FIGS. 8 and 9, Cda and Cva are capacitors in series, where Cda represents a diaphragm 20 and Cva represents an acoustic volume 7. The sound pressure level, Pal, coming from the acoustic load is divided such that the sound pressure level, Pva, across Cva is reduced proportionately. The microphone 30 also possesses a microphone diaphragm 33, Cdmic, and a volume, Cvmic, in series with each other. This combination can be represented by another acoustical capacitance, Cmic, with the microphone diagram 33 in parallel with the microphone volume.

The effects of the microphone acoustical capacitances must be considered when computing the attenuation unless the microphone diaphragm's capacitance is much lower than the attenuator volume's capacitance. If this is not true or if the exact calculation is wanted, Cmic may be measured with an acoustic compliance test system, which a person of ordinary skill in the art of microphone design or acoustical test measurements can design and build. However, the acoustical capacitance of a diaphragm, like the diaphragm film 25, is difficult to pre-calculate because it depends on the diaphragm's material, geometry, and tensioning. A preferred diaphragm film 25 made of mylar is the same material used for subminiature diaphragms in electret microphones and as the insulator in electrical capacitors. Mylar is readily available in various thicknesses applicable to subminiature systems, and when metalized it forms a barrier to problematic vapors that could potentially harm the microphone or its components. The addition of the metallization layer and the additional processes of forming, clamping, or tensioning make the formula for computing the capacitance difficult to generate from a theoretical model. However, the acoustical capacitance of a diaphragm, Cadia, is generally proportional to the area and thickness of the diaphragm.

In practice, an appropriate diaphragm design procedure would be to first select the diaphragm thickness that gave the best protective properties and the diaphragm area that seemed applicable. Next, acoustic capacitance would be measured with acoustic capacitance test equipment. The capacitance value would then be used to vary the diaphragm's area to achieve the desired capacitance so that, when used with a known fixed volume, the desired attenuation would be reached. Alternately, the attenuator's acoustic volume could be varied to achieve the desired attenuation. Accordingly, the design process is very flexible.

Specifically, FIG. 8 shows the electrical analog of the transfer of sound from its generation at the human mouth, to its transition to acoustic load, through the attenuator 1, and into a microphone 30. Suitably, FIG. 8 depicts an attenuator that preferably features a 6 mm face that is oriented at the chamber's open end or attenuator's acoustic volume 7. (See, e.g., FIG. 1A or 1B.) As noted above, the preferred diaphragm assembly is in the attenuator collar 3 and could have a diameter approaching 6 mm. Since the microphone 30 may be chosen with a much smaller diameter than the chamber or acoustic volume 7, the most efficient use of the space could be to place the microphone 30 internal to the acoustic attenuator with possibly the microphone end with the terminals just protruding from the volume 7. (See, e.g., FIG. 16.) A mathematical computation shows that the microphone volume is (2.5 mm/2)2*π*2.5 mm=12.27 $mm^3$. The external dimension of the chamber is (6.0 mm/2)2*π*10.0 mm=282.7 $mm^3$. The chamber volume to microphone volume ratio is a factor of 23:1, meaning the microphone does not appreciably reduce the chamber volume. However, the acoustic volume's 7 walls must be accounted for, and the wall thickness can be assumed to be 0.25 mm. The new ratio yields an external dimension of 225.7 $mm^3$ with a ratio of 18.39:1. As noted, the diaphragm film's 25 equivalent acoustic capacitance was approximately half the volume of the microphone, 6 $mm^3$, which yields an attenuation of about 31 dB. Additionally, the frequency can be better shaped to the microphone's response using smaller or larger pressure relief vents for the low frequencies and appropriate acoustic inductances and resistances for high resonances and roll offs. While the preferred embodiment is combining the attenuator 1 with a single sound inlet microphone, or a unidirectional microphone, in an alternate embodiment the acoustic attenuator 1 could be used with a multiple sound inlet microphone by placing an extra enclosure, or enclosures, in the attenuator for each additional sound inlet. For that alternate embodiment the capacitance computations would differ but would be easily calculable by a person skilled in the art.

In FIG. 8, the simplified impedance of the human sound system is represented by a capacitance (Cm) in series with a current source (Im). The acoustic load is represented by a radiation resistance (Rr), although it is not a true resistor. Between capacitors, inductors and resistors, resistors are the only element that removes energy from the system. Rr is more a contrivance to show that energy is transmitted away from the system because the sound pressure across Rr is dissipated into open space and as such, varies as 1/x2, where x is the distance from the mouth to the measurement point, here the attenuator/microphone assembly. In other words, Rr is not a true resistor since its value depends on frequency. Without a value of Rr that is independent of frequency, if we model the human voice system emanating from the mouth as a plane piston in an infinite baffle, according to Beranek ("Acoustics", p. 124), the radiation resistor's value varies as ω2, or (2*π*f)4, up to some frequency where the wavelength is commensurate with the driver's size. For higher frequencies the acoustic resistance is comparatively flat, meaning sound pressure level for a constant value of Im will rise by 12 dB/octave=40 dB/decade.

FIG. 9 shows another electrical analog of the transfer of sound from its generation by the human mouth, to its transmission represented by an Acoustic Load, through the Attenuator, and then into a Microphone. FIG. 9 is comparable to FIG. 8, the difference being that resistor, Rr, has been replaced by a capacitor, Cload. Cload may preferably be a capacitor whose value is: Cload=Vload/(ρoc2). This value is the result of the formula for the capacitance of a volume. As a capacitor, its impedance will vary with frequency as 1/ω=1/(2*π*f). This suitably means that, for a constant electrical current, the signal should fall with frequency at a rate of 6 dB/octave=20 dB/decade.

Figure 12:
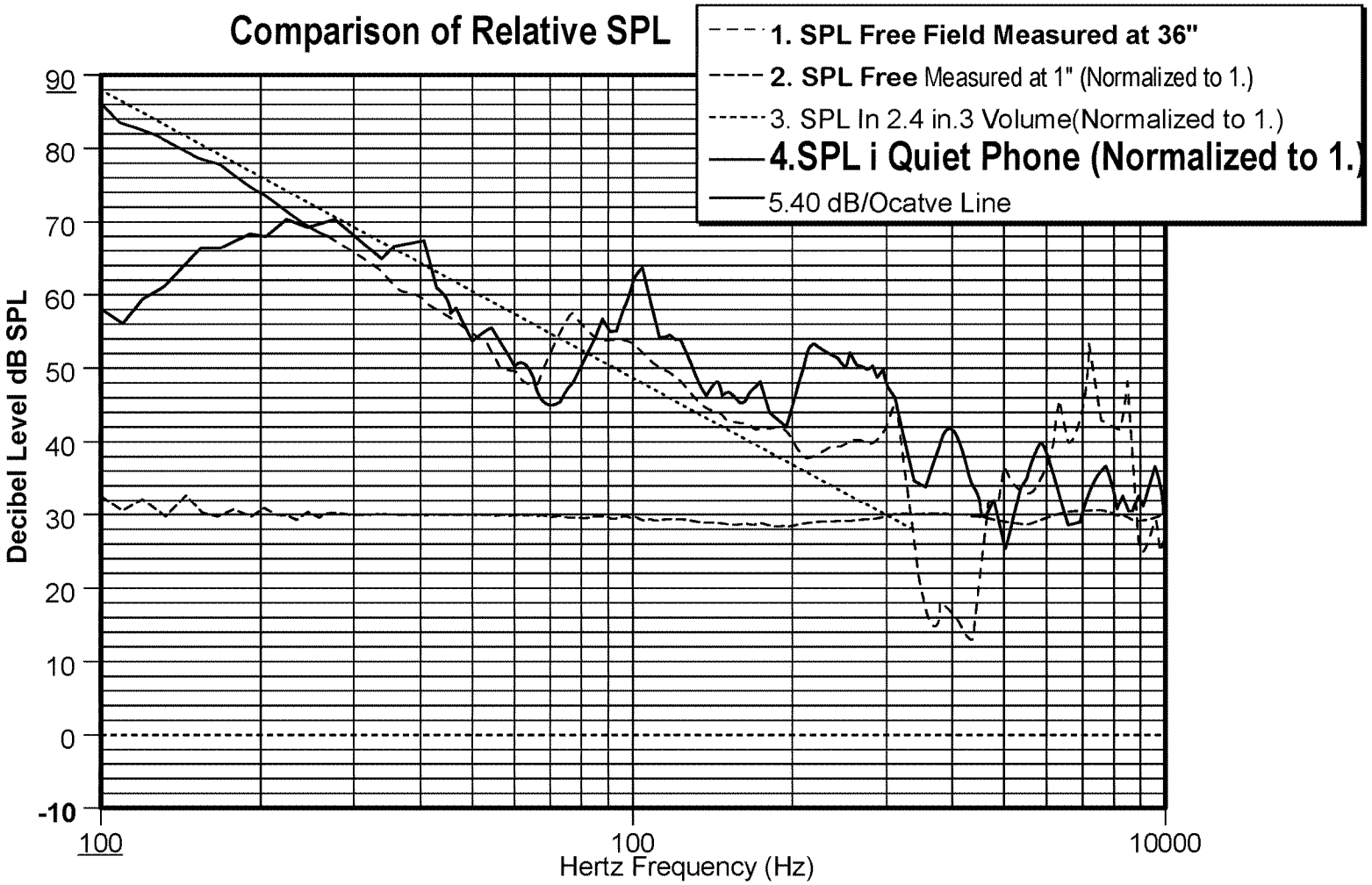
FIG. 12 is a graph showing sound pressure level at various distances from microphones with and without an acoustic attenuator.

FIG. 12 is a graph of frequency v. sound pressure level. The graph suitably compares actual measurements of the sound pressure level under different conditions as produced by the speaker for a horn driver, but without the horn itself. The size of the aperture of the speaker is 1.0". This might be suitable for a head and torso simulator (HATS) if it were equalized to a flatter response. To avoid acoustic frequency artifacts specific to the speaker chosen, the data is normalized to the sound pressure level measured at 36" for a free field. Therefore, the chart values for all frequencies in this data is set to 0 dB and has the reference number 1. The results can be compared for a free field measurement at 1" (line 2), the SPL into a 2.4 cubic volume (line 3), and into a Quiet Phone (line 4) (a quiet phone is a product by Quiet inc. and is generally described by U.S. Pat. No. 8,948,411 (issued Feb. 3, 2015) and this document and its family of patents are incorporated by reference in their entirety). The Quiet Phone also has a 2.4 cubic inch chamber, but also has a side voice exhaust channel from the mouth to the ear. The final line (line 5) is for reference and shows a minus 40 dB/octave slope, matching the slope for line 3. In view of the foregoing discussion, it is possible to calculate the sound pressure level under these different conditions assuming the same driver level offset. For instance, at 100 Hz, when 50 SPL is measured at 36" to the microphone, for the same drive level, 50+30=80 SPL will be measured at 1". Accordingly, 50+86=136 dB SPL will be measured into a 2.4 cubic closed chamber, but only 50+56=106 dB SPL into the pickup.

If, however, we take into account a higher driver level so that 70 dB SPL average is recorded at 36", but assume peak readings 15 dB higher, we get a maximum drive of 85 dB SPL. The numbers are then for each line at 100 Hz: =>85 dB SPL=>115 dB SPL=>171 dB SPL=>141 dB SPL. The side channel of the Quiet Phone does help, but an Acoustic Attenuator of 30 dB or more is obviously called for. With the Quiet Phone side channel and the attenuator, the level would be 141−30=111 dB, which is close to a conventional miniature microphone's limit. Without the side channel into the same enclosed volume, the level is 171−30=141 dB, resulting in severe distortion.

Figure 11:
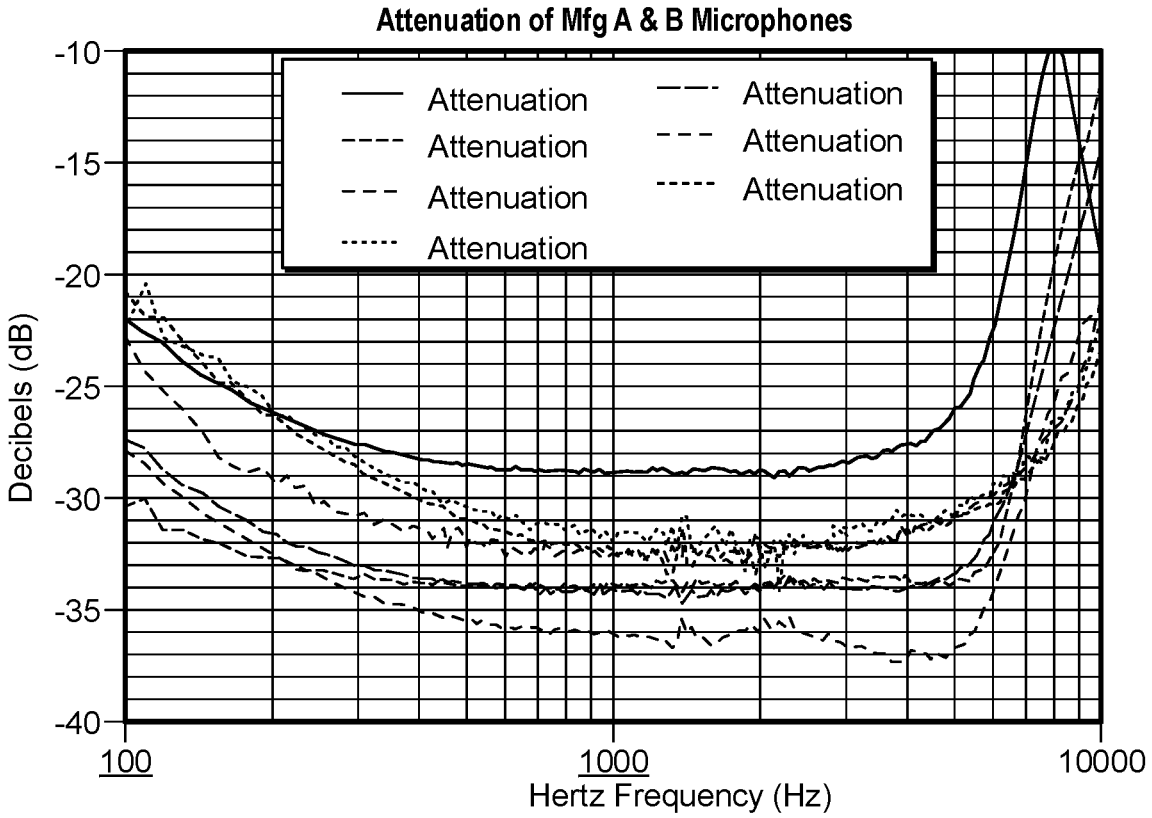
FIG. 11 is a graph showing measured attenuation of seven 30 dB acoustic attenuators and microphone assemblies made with microphones of two different dimensions.

FIG. 11 shows a graph measuring attenuation of seven 30 dB acoustic attenuators. It would be preferred that the acoustic attenuator had a perfectly flat response over the entire acoustic band of 20 Hz to 20 kHz. As can be seen in FIG. 11, there are some limitations to the attenuators discussed so far. In general, for all of the microphone/attenuator combinations shown, the attenuation decreases at both the high and low frequencies, with greater change at high frequencies. The performance shown is completely adequate for speech quality and intelligibility, covering the range 200 Hz to 8 kHz, but this range can be improved.

The simplest improvement is electrical equalization. The shape of the attenuation does differ between the two microphone models, but for the examples of the particular model, the shapes are fairly constant, so an equalization network should give a consistent performance. It is true that the overload margin for the preamplifier is decreased, but the acoustic energy for speech is predominantly in the central portion of the curve and may not be a problem. However, there are methods to improve the shape of the attenuation curve that precede the microphone.

Returning to FIG. 10, the network showing the acoustical analogs, there are additional elements that occur in the mesh, beyond those shown of FIG. 8 or FIG. 9.

The ones that degrade performance are as follows:

Rdavt, the acoustic vent for the attenuator diaphragm;

Lda, the acoustic inductance leading to the attenuator diaphragm;

Rda, the resistive damping of air leading to the attenuator diaphragm;

Ldmic, the acoustic inductance leading to the microphone diaphragm;

Rdmic, the resistive damping of air leading to the microphone diaphragm; and,

Rdmicvt, the acoustic vent for the microphone diaphragm.

Suitably, the first three cause the attenuation reduction at the low and high frequencies. Rdavt bypasses the attenuator diaphragm and should be as small as possible to have acoustic impedance as high as possible. Lda causes a peaking in the response shape within the pass band of the attenuator and should be as small as possible to shift the peak above the upper end of the pass band. Rda controls damping of the peak at the attenuator and should be set to flatten that peak. The last three can be set to minimize the attenuation's degradation, and the values need to be selected essentially are as in the preceding paragraph for the respective element. Unfortunately, the only way to do this is to design the microphone or select the microphone so that those criteria are met. Designing the microphone results in a more expensive microphone. Selecting the microphone is more cost efficient given the large number of microphone manufacturers, each with very broad product lines.

Returning to FIG. 11, the graph shows the results of applying the Acoustical Attenuator to seven microphones, four from one manufacturer and three from another. The first four from manufacturer A used the Acoustical Attenuator shown on FIGS. 5 & 6 (type D). The microphones' dimensions are 9.7 mm diameter and 5 mm length for a volume of 370 $mm^3$. The last three use the same attenuator housing as on FIGS. 5 & 6 with the addition of the adaptor ring shown in FIG. 6 (type E), as the microphones from manufacturer B have smaller 6.0 mm diameters and 3.4 mm lengths mm for a volume of 96.1 $mm^3$. The volume ratio is about 4:1 for external dimensions. As can be seen in the graph, microphones from manufacturer B seemed to be more uniform than manufacturer A's, but these were prototype assemblies made over a period of time using salvaged diaphragms. It is possible that some or all of the variations are due to problems caused by the salvage operation.

Returning again to FIG. 10, as noted earlier, the diaphragm for the acoustic attenuator (Cda) protects the microphone after attaching the acoustic attenuator. Both the attenuator 1 and microphone diaphragm 33 must be protected from damage during assembly. There are two problem concerns. The first is the attaching the acoustic attenuator to the microphone. It is possible to increase or decrease the attenuator's 1 pressure by orders of magnitude than any sound pressure level the microphone or the attenuator is normally exposed to by sliding the attenuator assembly forwards and backwards, respectively. It is also possible to expose both diaphragms to the vapors of the cements. Both effects may be minimized by providing a small relief hole in the attenuator 1, open while the cements are applied to the mating parts. This allows the pressure in the attenuator to equalize while the process is done, and the cement is cured. A small dab of cement can then be used to seal this vent.

The attenuator's level of attenuation can be checked before the microphone is cemented to the attenuator because the small leaks between the attenuator and the microphone will not affect the attenuation at or above 1 kHz when the vent hole is sealed with tape. The attenuator may be removed using its flange and replaced, even if the cement is strong enough to retain the microphone to the attenuator, although in a preferable embodiment the cement bond is breakable. When the bond is not breakable, a vent hole can be created in the attenuator's face and covered by tape while the assembly is checked and possibly replaced; as discussed, the tape sufficiently seals the vent hole to not affect attenuation. After the result is satisfactory, the vent hole can be covered over with a suitable viscous cement. Suitably, if the attenuator diaphragm is damaged after the assembly and after the vent hole is sealed, the diaphragm can be replaced by peeling back the viscous cement layer and replacing the diaphragm. Furthermore, the attenuator's volume can be ensured to be accurate if positive stops are used.

Additionally, adjusting the length of the chamber forming Cvol can also vary the attenuation. For example, in FIGS. 1A and 7A this could be achieved by sliding the microphone further in or further out of the sleeving. In FIG. 4, the walls forming Cvol could be telescoped back and forth to achieve the same effect; increasing the diameter of the chamber forming Cvol easily creates greater attenuation. Accordingly, FIG. 5 could be considered preferable to FIG. 4 because of FIG. 5's greater volume.

Furthermore, adjusting the attenuation also adjusts the microphone's sensitivity. The adjustment could be used to achieve better uniformity from microphone to microphone because the base microphones' sensitivity normally varies by +/−3 dB to +/−4 dB according to industry specifications.

For multi-inlet microphones, especially directional and noise canceling microphones, it is necessary to provide an acoustic attenuator for each sound inlet. It is necessary that the attenuator does not alter the level or phase of the input signals presented at each sound inlet. This is possible to achieve by matching the attenuators as they are built and then testing them to ensure good amplitude and phase match; a selection process to form a matched set is reasonable.

Figure 13:
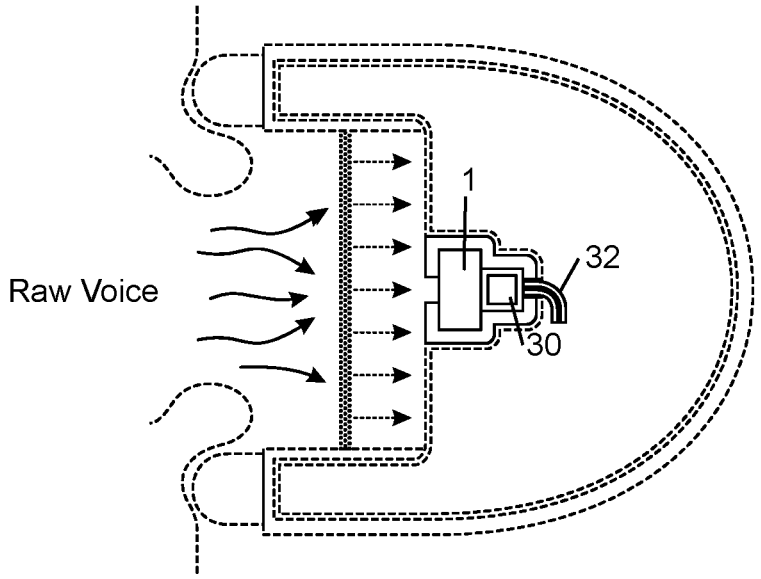
FIG. 13 is a cross sectional view of the attenuator inside a telephone handset.
Figure 14:
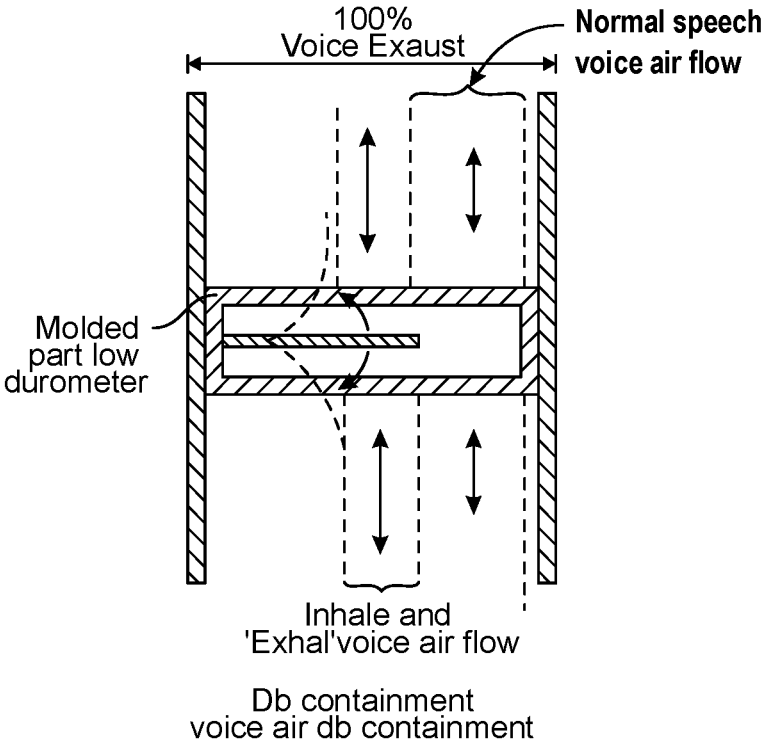
FIG. 14 is a cross sectional view of a decibel containment voice exhaust two-way voice valve.
Figure 15:
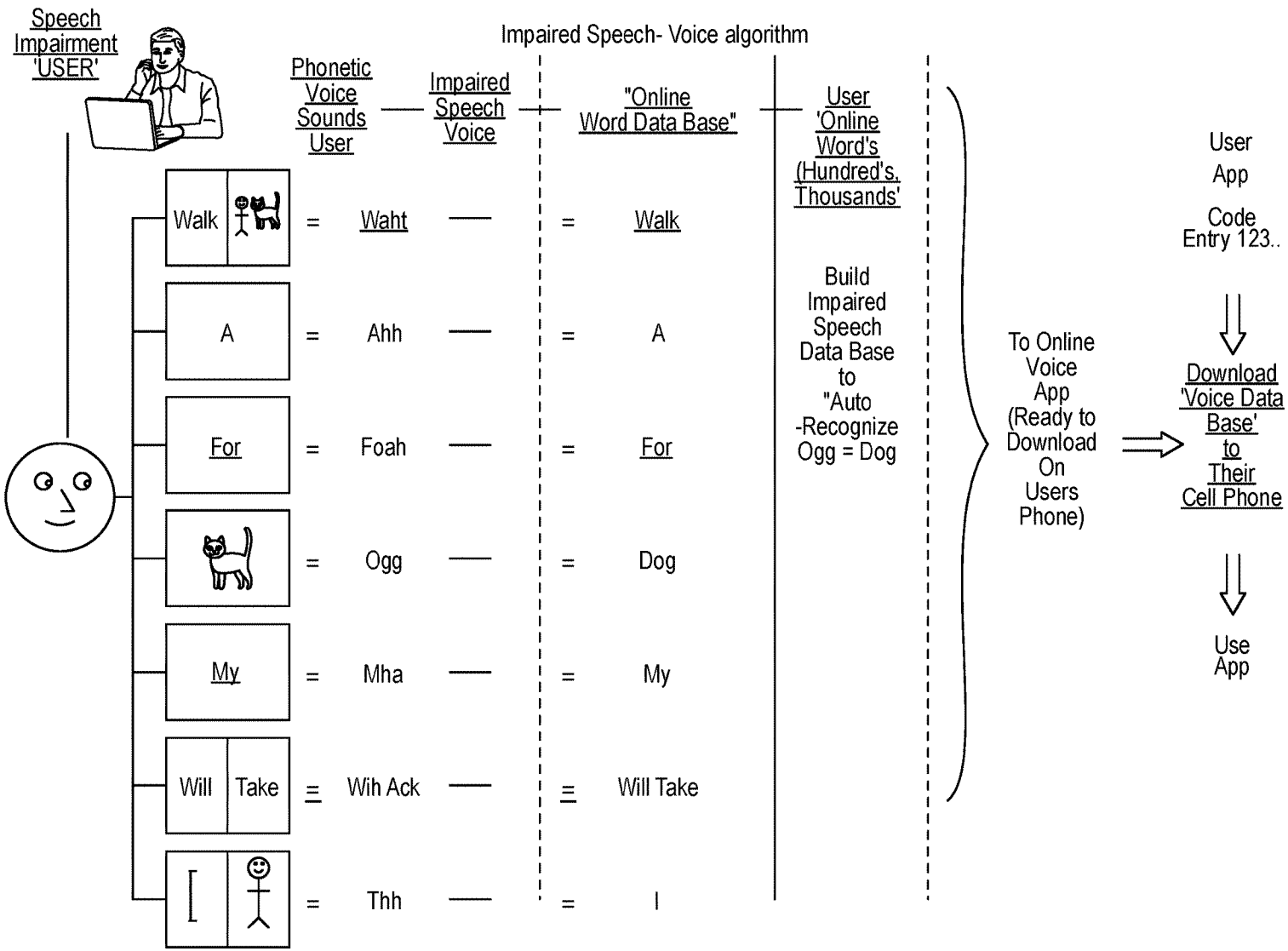
FIG. 15 is a diagram of the acoustic attenuator used with a voice algorithm to accurately translate compromised or impaired speech at a close distance to the microphone; and, FIG. 16 is a flowchart with the voice algorithm to translate speech from raw voice input to digital output.

FIGS. 13 and 14 show an improved housing for a microphone that is configured to reduce the plosive raw voice of regular or impaired speech. As shown in FIG. 14, the side channel of the quiet phone suitably includes a low durometer voice air flow flap for exhale speech and inhale life air intake as needed for plosive words require more air flow for pronunciation. Suitably, the area for voice air intake and exhaust may be always open for normal speech and air inhalation but closed off during expression of plosive words. In other words, the flap design provides an area for the flap to open both outwardly and inwardly (both ways) and, as a result, assists with sound containment in the voice capture area of the quiet phone. As shown in FIG. 13, a speaker's face is hermetically sealed by contact of the phone handset against the speaker's face. Suitably, the chamber features a hermetically sealed plosive energy screen to remove voice plosive air pressure during expression into the phone. Further shown in FIG. 13, an attenuator—30 dB substantially lowers peak to peak dB energy prior to electret microphone pickup and the attenuator is suitably surrounded by dense memory foam with slow rebound time and this further attenuates voice sounds as they attempt to escape the quiet phone. As a result, the microphone receives sounds with a lower peak to peak electrical signal that is not distorted.

Figure 16:
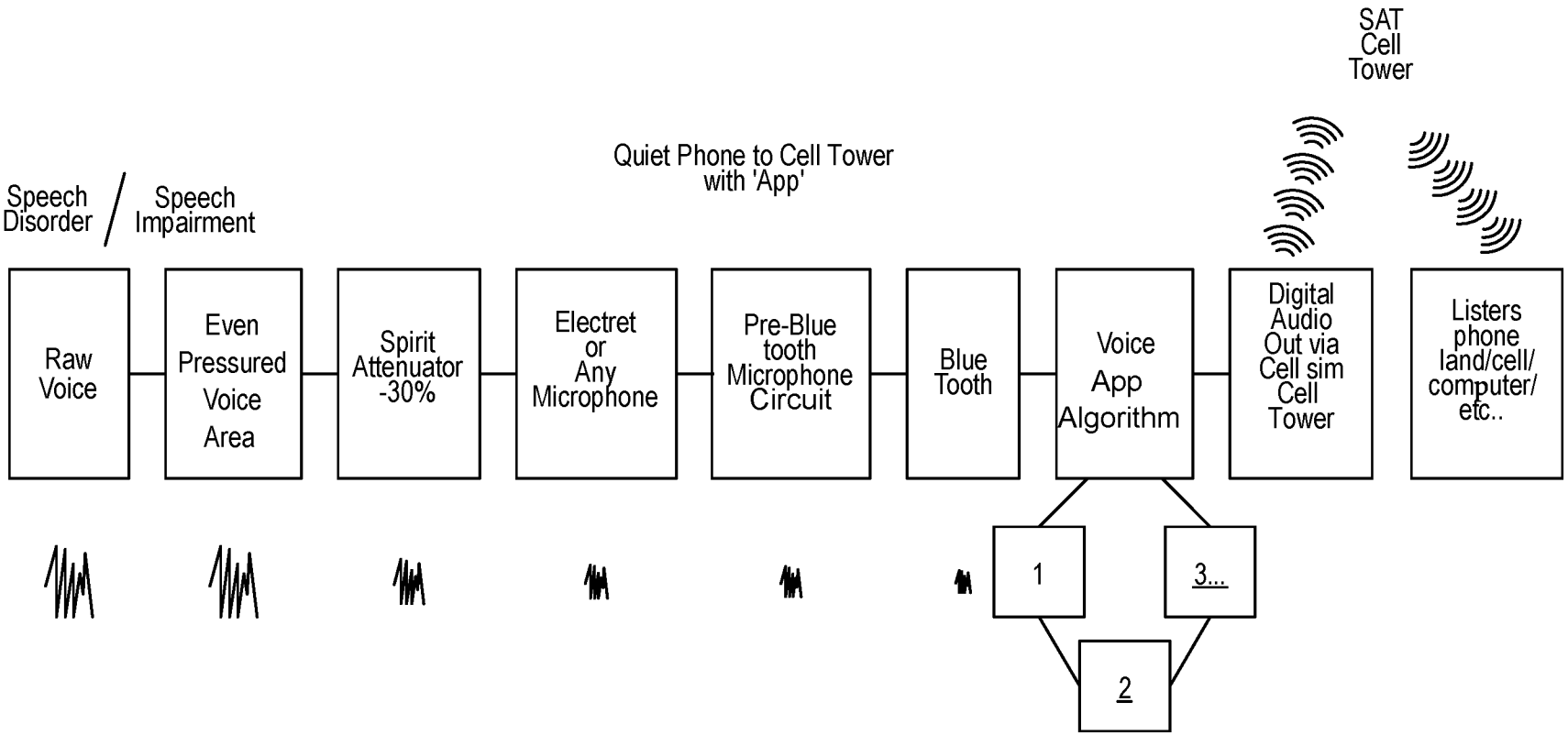

FIGS. 16 and 17 depict a flow chart and diagram for assisting communication of an individual that has a speech disorder or impaired speech. As shown, a user may be shown an image and asked to describe what is seen in order to build a vocabulary of words representing the user's impaired vocabulary. Suitably, a database of the user's impaired speech and associated vocabulary is saved in a database such that when a user speaks impaired speech into the quiet phone, corrected robotic speech or else voice to text is output from the quite phone to a microphone or graphical user interface. As shown in FIG. 17 a user's raw voice may be provided into a chamber of a handset that produces even pressure of the voice (see FIGS. 13 and 14). Preferably, the chamber of the handset may include an attenuator and microphone as described above for picking up a nondistorted signal of the user's impaired speech. Suitably, a computerized speech recognition software application may thereafter be used to compare the input impaired speech to a database of impaired speech associated with correct vocabulary such that corrected robotic speech or else voice to text is output from the quite phone to a microphone or graphical user interface.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A passive acoustic attenuator comprising:
an enclosed volume comprising at least one aperture;
a microphone; and,
a diaphragm assembly occupying said aperture, wherein the diaphragm assembly passively and reactively reduces the sound level coming into the microphone.

2. The acoustic attenuator of claim 1 wherein the enclosed volume entirely contains the microphone.

3. The acoustic attenuator of claim 1 wherein:
the enclosed volume partially encloses the microphone through a second aperture; and,
a microphone inlet is sealed to the enclosed volume's second aperture.

4. The acoustic attenuator of claim 1 wherein the attenuator is reduced in net size for the same attenuation by the use of two attenuator sections.

5. The enclosed volume of claim 1 wherein the microphone is physically protected by being inside the enclosed volume.

6. The diaphragm assembly of claim 1 wherein the diaphragm assembly is removable and replaceable.

7. The diaphragm assembly of claim 6 wherein the diaphragm assembly is attached to a first aperture of the enclosed volume.

8. The microphone of claim 1, where in the microphone is miniature to sub-miniature in size.

9. The acoustic attenuator of claim 1 further comprising a microphone adapter ring, where the microphone adapter ring is sized accordingly to use the attenuator with differently sized miniature to sub-miniature microphones.

10. A method of picking up at least one speech sound comprising the steps of:

enclosing a microphone in an acoustic attenuator that has a diaphragm assembly occupying an aperture of at least one volume of space for attenuating an acoustic speech sound;

screening the plosive energy of the speech sound;

attenuating the speech sound via passively reducing the sound level of the acoustic speech sound;

picking up the acoustic speech sound via the microphone; and, converting the acoustic speech sound into an electric signal.

11. The method of claim 10 further comprising the step of controlling the attenuation of the acoustic sound via modifying the volume of space of the attenuator.

12. The method of claim 10 wherein the microphone is enclosed in the volume of space for attenuating the acoustic sound.

13. The method of claim 10 wherein the step of screening the plosive energy of the speech sound produces even pressure of the voice sound so that the voice sound may be picked up by the microphone with minimal distortion.

14. The method of claim 13 further comprising the step of exhausting the voice sound through a decibel containment voice exhaust two-way voice valve.

15. A passive acoustical attenuator for a microphone, said acoustical attenuator combining attenuation to lower a sound level of a sound introduced into the microphone with physical protection for the microphone, said acoustical attenuator defined by an enclosed volume of space bounded by a sound inlet at the proximate end, containing a diaphragm structure and bounded at the distal end by a sound outlet sealed to a microphone, wherein the sound entering at the proximate inlet is reduced in level according to the divider effect of acoustical compliances of the diaphragm and the enclosed volume of space that is approximately constant over a wide acoustical range of speech.

16. An attenuator as in claim 15 where the microphone to which it is attached is miniature to sub-miniature in size.

17. An attenuator as in claim 16 wherein the diaphragm structure is removable and replaceable.

18. An attenuator as in claim 17 where the attenuator is reduced in net size for the same attenuation by the use of two attenuator sections.

* * * * *